US011142971B2

(12) United States Patent
Samuel et al.

(10) Patent No.: US 11,142,971 B2
(45) Date of Patent: Oct. 12, 2021

(54) SYSTEMS AND METHODS FOR DETECTING KICK AND WELL FLOW

(71) Applicant: LANDMARK GRAPHICS CORPORATION, Houston, TX (US)

(72) Inventors: Robello Samuel, Cypress, TX (US); Yuan Zhang, Missouri City, TX (US)

(73) Assignee: Landmark Graphics Corporation, Houston, TX (US)

( * ) Notice: Subject to any disclaimer, the term of this patent is extended or adjusted under 35 U.S.C. 154(b) by 90 days.

(21) Appl. No.: 16/491,701

(22) PCT Filed: Dec. 28, 2017

(86) PCT No.: PCT/US2017/068836
§ 371 (c)(1),
(2) Date: Sep. 6, 2019

(87) PCT Pub. No.: WO2018/231278
PCT Pub. Date: Dec. 20, 2018

(65) Prior Publication Data

US 2021/0131272 A1 May 6, 2021

Related U.S. Application Data

(60) Provisional application No. 62/521,353, filed on Jun. 16, 2017.

(51) Int. Cl.
*E21B 21/08* (2006.01)

(52) U.S. Cl.
CPC ..... *E21B 21/08* (2013.01)

(58) Field of Classification Search
CPC ..... E21B 21/08
See application file for complete search history.

(56) References Cited

U.S. PATENT DOCUMENTS

| | | | | |
|---|---|---|---|---|
| 5,006,845 | A | 4/1991 | Calcar et al. | |
| 5,154,078 | A | 10/1992 | Codazzi | |
| 7,762,131 | B2 | 7/2010 | Ibrahim et al. | |
| 2008/0047337 | A1 | 2/2008 | Chemali et al. | |
| 2012/0170406 | A1* | 7/2012 | DiFoggio ..... | G01N 29/028 367/35 |

(Continued)

FOREIGN PATENT DOCUMENTS

| | | | |
|---|---|---|---|
| GB | 2501741 | A | 6/2013 |
| WO | 2010138718 | A1 | 12/2010 |
| WO | 2015190932 | A1 | 12/2015 |

OTHER PUBLICATIONS

International Search Report and Written Opinion dated Apr. 19, 2018, of PCT/US2017/068836, filed on Dec. 28, 2017.

*Primary Examiner* — D. Andrews
(74) *Attorney, Agent, or Firm* — Chamberlain Hrdlicka

(57) ABSTRACT

Systems and methods for detecting a gas kick within a wellbore are provided. The system includes a rotatable tool including one or more acceleration sensors and/or oscillators. The method includes rotating the rotatable tool in contact with fluid inside the wellbore and detecting changes in rotational velocity of the rotatable tool to detect the gas kick. In other aspects, the method includes detecting a change in density of the fluid within the wellbore by at least one or more pressure waves to determine the gas kick within the wellbore.

12 Claims, 5 Drawing Sheets

(56) References Cited

U.S. PATENT DOCUMENTS

| | | | | |
|---|---|---|---|---|
| 2012/0298421 | A1* | 11/2012 | Coates | E21B 47/107 175/50 |
| 2013/0120154 | A1 | 5/2013 | Gleitman et al. | |
| 2013/0341094 | A1 | 12/2013 | Taherian et al. | |
| 2015/0101865 | A1* | 4/2015 | Mauldin | E21B 47/024 175/40 |
| 2016/0237810 | A1* | 8/2016 | Beaman, Jr. | E21B 41/00 |

* cited by examiner

SYSTEMS AND METHODS FOR DETECTING KICK AND WELL FLOW

BACKGROUND

This section is intended to provide relevant background information to facilitate a better understanding of the various aspects of the described embodiments. Accordingly, it should be understood that these statements are to be read in this light and not as admissions of prior art.

During a drilling operation, gases from the subterranean formation can enter the wellbore to produce a "gas kick". The kick is caused by the pressure in the wellbore being less than that of the formation fluids, thus causing flow. This condition of lower wellbore pressure than the formation can be caused in two ways. First, if the mud weight is too low, then the hydrostatic pressure exerted on the formation by the fluid column may not be sufficient to hold the formation fluid in the formation. This type of kick might be called an underbalanced kick. The second way a kick can occur is if dynamic and transient fluid pressure effects, usually due to motion of the drill string or casing, effectively lower the pressure in the wellbore below that of the formation. This second kick type could be called an induced kick.

If the gas kick is not detected and controlled, the gas kick may result in a blowout condition of the well. Several methods for detecting a gas kick have included monitoring the differential flow of mud during a drilling operation and measuring the circulation pressure. In differential flow detection, a substantial increase in the rate of return mud flow without a corresponding increase in the input flow is indicative of an impending blowout. However, a negative aspect with differential flow detection is that long integrating periods are needed to observe small differential flow. During this delay of time, a large amount of compressed gas can accumulate, move into the well, and enter the well structure before remedial action is implemented.

In circulation pressure detection, the pressure needed to circulate the drilling fluid through the well is monitored and represents the sum total of all pressure drops throughout the system. Fluctuations in the circulation pressure indicate when substantial changes in wellbore conditions have occurred. However, these fluctuations do not indicate when subtle changes in wellbore conditions have occurred. As such, a gas kick can be completely overlooked or only detected with too little time to take remedial action.

Therefore, there is a need for improved systems and methods for detecting a gas kick within a wellbore.

BRIEF DESCRIPTION OF THE DRAWINGS

Embodiments of the invention are described with reference to the following figures. The same numbers are used throughout the figures to reference like features and components. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

Embodiments herein provide systems and methods for detecting a gas kick within a wellbore extending through a subterranean formation. The systems include a rotatable tool including one or more acceleration sensors and/or one or more oscillators coupled thereto. In one or more embodiments, a method for detecting the gas kick includes rotating the rotatable tool within the wellbore in contact with the fluid, monitoring and detecting changes in rotational velocity of the rotatable tool, and detecting an approaching bubble or gas kick within the wellbore. For example, the method can include detecting changes in the rotational velocity to produce vibration data, determining a damping factor from the vibration data, determining a viscosity of the fluid, monitoring at least one of the damping factor or the viscosity, and determining the presence of a gas bubble in the fluid by detecting a reduction of the damping factor or the viscosity.

In other embodiments, a method for detecting the gas kick includes rotating the rotatable tool within the wellbore in contact with the fluid, detecting a change in density of the fluid within the wellbore by at least one or more pressure waves, and determining presence of the gas kick within the wellbore from the detected change in density of the fluid. For example, the method can include producing a first pressure wave within the wellbore, measuring a first velocity of the first pressure wave within the wellbore, determining a primary density of the fluid from the first velocity of the first pressure wave, producing a second pressure wave within the wellbore, measuring a second velocity of the second pressure wave within the wellbore, determining a secondary density of the fluid from the second velocity of the second pressure wave, where the primary and secondary densities are different, and determining presence of the gas kick within the wellbore from the difference between the primary and secondary densities of the fluid.

Figure 1:
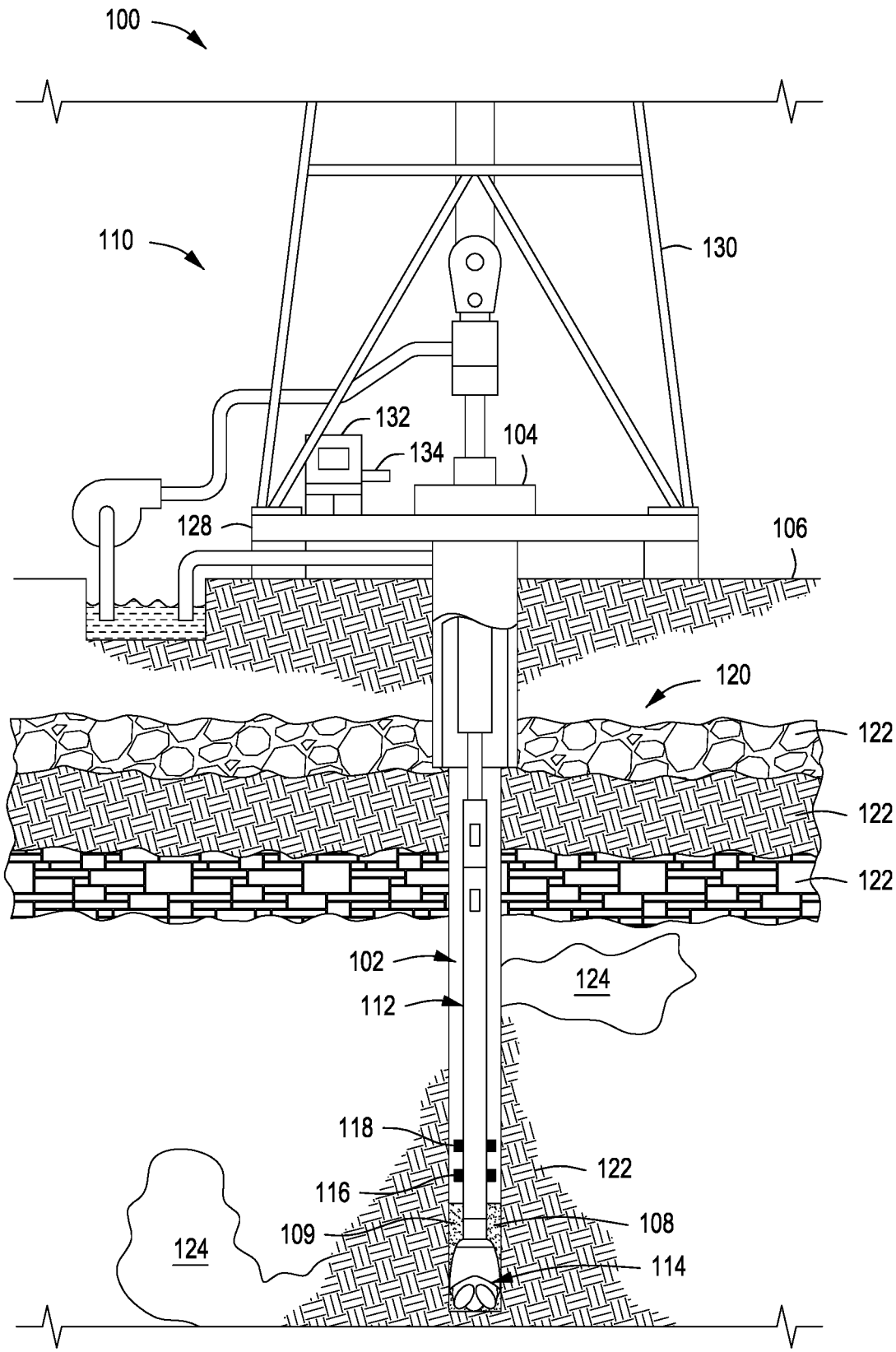
FIG. 1 depicts a drilling system located downhole in a wellbore, according to one or more embodiments.

FIG. 1 depicts a schematic view of a drilling operation deployed in and around a drilling and detection system 100, according to one or more embodiments. The drilling and detection system 100 is located in and around a wellbore 102 and on a ground surface 106. The wellbore 102 is formed within a subterranean region 120 beneath the ground surface 106. The wellbore 102 contains one or more fluids 108, such as drilling fluid, production fluids, fracturing fluids, other downhole or annular fluids, or any combination thereof. Gas bubbles 109 are contained in the fluid 108 within the wellbore 102. The gas bubbles 109 contain one or more of formation gas, production gas, gas formed from the fluid 108, such as by decomposing or changing state of matter, or any combination thereof.

The subterranean region 120 includes all or part of one or more subsurface layers 122, one or more subterranean formations 124, subterranean zones, and/or other earth formations. The subterranean region 120 shown in FIG. 1, for example, includes multiple subsurface layers 122 and subterranean formations 124. The subsurface layers 122 can include sedimentary layers, rock layers, sand layers, or any combination thereof and other types of subsurface layers.

One or more of the subsurface layers 122 can contain fluids, such as brine, oil, gas, or combinations thereof. The wellbore 102 penetrates and extends through the subsurface layers 122. Although the wellbore 102 shown in FIG. 1 is a vertical wellbore, the drilling and detection system 100 can also be implemented in other wellbore orientations. For example, the drilling and detection system 100 may be adapted for horizontal wellbores, slant wellbores, curved wellbores, vertical wellbores, or any combination thereof.

A drilling rig 110 includes a platform 128 located above the surface 106 equipped with a derrick 130 that supports a rotatable tool or a drill string 112 extending through a well head 104 and into the wellbore 102. The drill string 112 is operated to drill the wellbore 102 while penetrating the subterranean region 120. The drill string 112 can be or include, but is not limited to, one or more drill pipes (e.g., jointed drill pipe, hard wired drill pipe, or other deployment hardware), tubulars, coiled tubings, slicklines, wireline cables, tractors, a kelly, a bottom hole assembly (BHA), other conveyance devices, or any combination thereof. For example, drilling can be performed using a string of drill pipes connected together to form the drill string 112 that is lowered through a rotary table (not shown) at the well head 104 into the wellbore 102. The BHA on the drill string 112 can include, but is not limited to, one or more of drill collars, drill bits 114, sensors 116, oscillators 118, logging tools, other components, and/or any combination thereof. For example, the drill string 112 includes one or more drill bits 114 at the downhole end. Exemplary logging tools can be or include, but are not limited to, measuring while drilling (MWD) tools and logging while drilling (LWD) tools.

The drilling and detection system 100 also includes a computing and control system 132. The computing and control system 132 receives and analyzes data and transmits commands or instructions. In one configuration, the computing and control system 132 receives and analyzes data from one or more sensors 116 and controls one or more oscillators 118. In some examples, the computing and control system 132 can also be used to implement a protocol taking remedial action for controlling a gas kick that has been detected. An alarm prediction unit 134 is communicably and operably connected to the computing and control system 132 and can be used to activate alarms for predefined drilling conditions. For example, a kick alarm provides an early warning of a dangerous influx of the fluid 108 within the wellbore 102.

Figure 2:
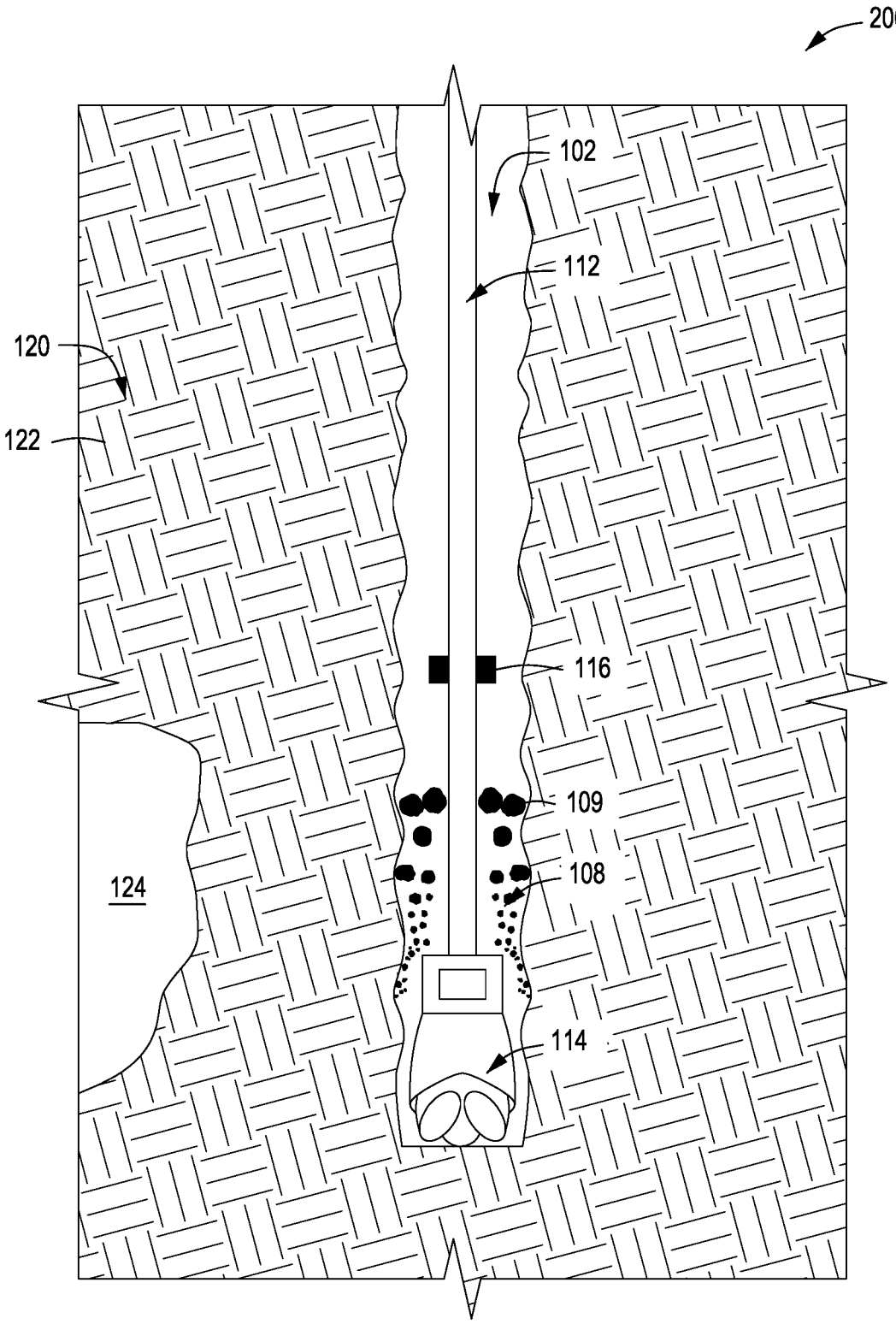
FIG. 2 depicts a system including an acceleration sensor and used for detecting gas kick within a wellbore, according to one or more embodiments.

FIG. 2 depicts a drilling and detection system 200 including one or more acceleration sensors 116 used to detect gas kicks within the wellbore 102, according to one or more embodiments. As depicted, the drill string 112 including the drill bit 114 is extended into the wellbore 102 that is drilled into the subterranean region 120 through subsurface layers 122 and into subterranean formations 124.

The sensors 116 are attached on the drill string 112 uphole from the drill bit 114 and used to detect gas kicks. Exemplary sensors 116 can be or include, but are not limited to, one or more acceleration sensors, speed or velocity sensor, frequency sensor, or any combination thereof. During drilling operations, the wellbore may be subjected to an inflow of formation fluids, or a "kick," as described above. When the gas, fluid, or oil kick happens, the gas bubble 109 enters and mixes with the fluid 108 in the wellbore. The gas bubble 109 can be a mixture of gas and liquid (e.g., bubble at least partially surrounded by liquid and/or other gas) and/or an amount of gas without liquid. Since the gas bubble 109 is a lower viscosity and density, the gas bubble 109 reduces the overall viscosity of the fluid 108, for example, the fluid 108 located in the annulus or wellbore 102. This reduction in fluid viscosity causes the degradation of the damping factor.

The sensor 116 located on the drill string 112 detects the velocity and/or acceleration change of the drill string 112 due to the decreased damping factor and sends the signal to the computing and control system 132 on the ground surface 106. The change in velocity and/or acceleration can be in any direction including the x-axis, y-axis, and/or z-axis relative to the z-axis being along the length of the drill string 112. The change in velocity and/or acceleration can also be a change in the axial rotation and/or vibration of the drill string 112.

The method to calculate the damping factor based on the vibration data can be as provided below. When the fluid influx into the wellbore 102 happens and migrates through the wellbore, the damping factor will have a strong effect. The damping factor can be calculated using the following equation:

$$\{P\}=\{I\}+[C]\{\dot{u}\}+[M]\{\ddot{u}\}.$$

The above equation can be given as follows:

$$\{p(t)\}=\{I(u,t)\}+[C]\{u'(t)\}+[M]\{u'(t)\}, \text{ wherein:}$$

{p(t)}=Applied Load Vector (or forcing function) at time t;

{u(t)}=Displacement Vector at time t;

{I(u,t)}=internal force vector at time t and displacement state;

[M]=Mass matrix;

[C]=Damping matrix;

{ } indicates a vector quantity;

[ ] indicates a matrix quantity; and

' indicates differentiation with respect to time t.

The damping matrix can be calculated using the following equation:

$$[C] = [C_R] + [C_s] + [C_V] + \sum_{e=1}^{Nel} [C_e].$$

The $[C_R]$ Rayleigh or proportional damping on the BHA vibrational response can be calculated using the following equation:

$$[C_R]=\alpha_R[M]+\beta_R[K].$$

The $[C_S]$ structural damping, which is assumed to be proportional to displacement but in phase with the velocity of a harmonically oscillating BHA can be calculated using the following equation:

$$[C_s] = \frac{2\xi_s}{\omega}[K] + \frac{2\xi_c}{\omega}[K].$$

The $[C_V]$ matrix is due to the influence of viscous damping effects acting on the vibrating BHA (e.g., the $[C_V]$ matrix represents energy dissipated by fluid friction). The $[C_V]$ matrix can be used to identify the amount of influx into the formation as this is dependent on the frequency. The $[C_V]$ matrix can be calculated using the following equations:

$$[C_v] = \frac{M}{m}\left[\frac{(f_n)_{gas/oil}}{f_n} - 1\right],$$

wherein:

$$f_n = \left(\frac{1}{2\pi}\right)\frac{a^2}{l^2}\sqrt{\frac{EI}{M + mC_m}} \text{ and } (f_n)_{gas/oil} = \left(\frac{1}{2\pi}\right)\frac{a^2}{l^2}\sqrt{\frac{EI}{m}},$$

wherein:

a is the mode constant; EI flexural rigidity; l is the length; M is the string mass per unit length; m is the fluid displaced; and C[m] is the added mass correction factor.

Further the above equation can be reduced as to the following formula:

$$\frac{f_n}{(f_n)_{gas/oil}} = \sqrt{\frac{M}{M + mC_m}}.$$

The ratio can be plotted in real time and compared against as the well is drilled—with all other parameters remaining constant, the amount of influx m, can be estimated from which the density of the influx fluid can be calculated. In one or more examples, the model can be initially calibrated to obtain the added mass correction factor.

In one or more embodiments, a method for detecting the gas kick includes rotating the drill string 112 or other rotatable tool within the wellbore 102 in contact with the fluid 108, monitoring and detecting changes in rotational velocity of the drill string 112, and detecting an approaching bubble or gas kick within the wellbore 102. The method can include detecting changes in the rotational velocity of the drill string 112 to produce vibration data. The rotational velocity of the drill string 112 is detected by one, two, or more acceleration sensors 116 coupled to the drill string 112. A damping factor is determined from the vibration data. The viscosity of the fluid 108 is also determined. The influx fluid density for at least one of oil, gas, water, or any combination thereof is determined and the mass influx of the fluid 108 is determined. Thereafter, the damping factor and/or the viscosity are monitored and the presence of a gas bubble or gas kick in the fluid 108 is determined by detecting a reduction of the damping factor or the viscosity.

Figure 3:
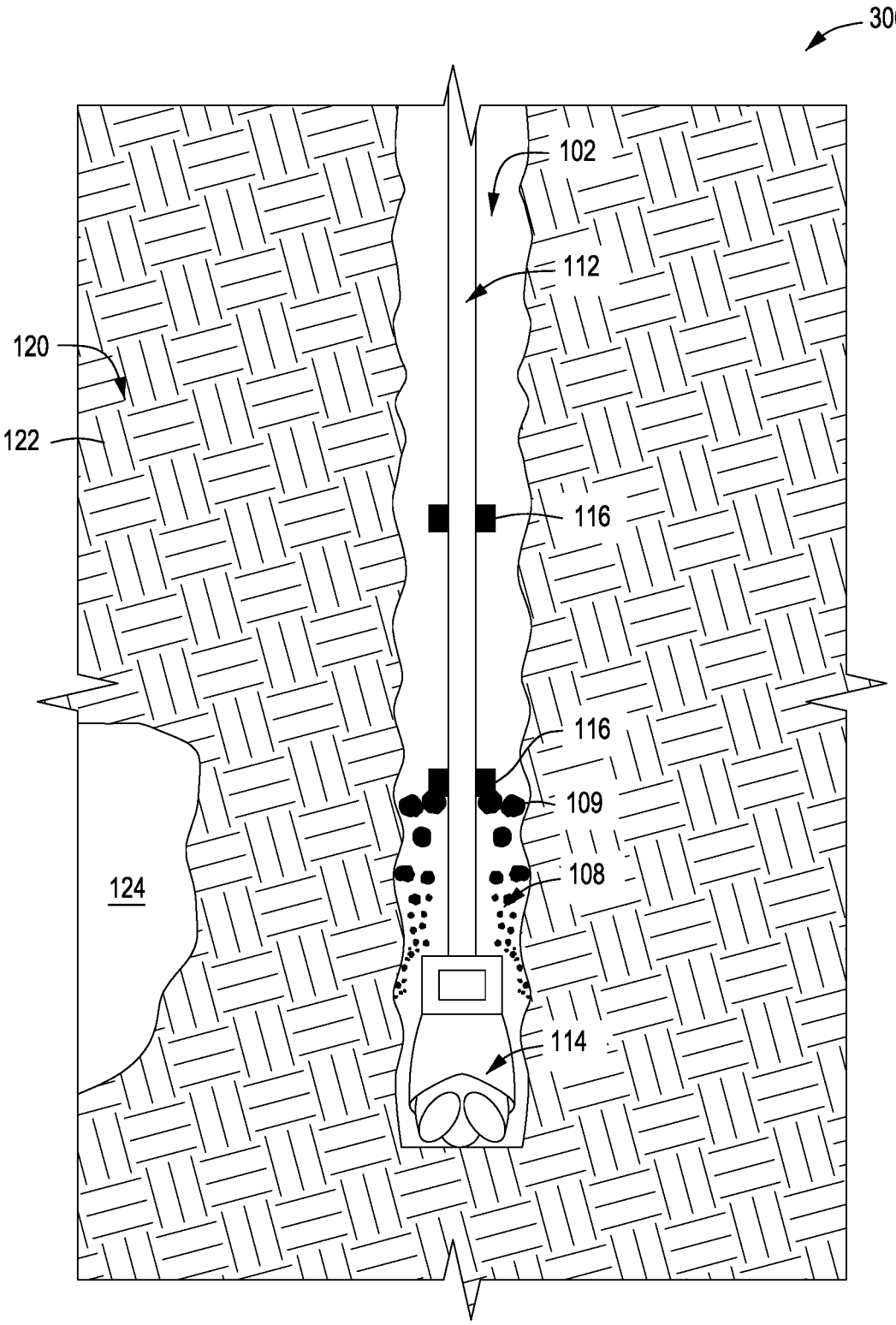
FIG. 3 depicts a system including two or more acceleration sensors and used for detecting gas kick within a wellbore, according to one or more embodiments.

FIG. 3 depicts a drilling and detection system 300 including two or more acceleration sensors 116 used to detect gas kicks within the wellbore 102, according to one or more embodiments. As depicted, the drill string 112 including the drill bit 114 is extended into the wellbore 102. The wellbore 102 is drilled into the subterranean region 120 that includes subsurface layers 122 and subterranean formations 124.

Two or more acceleration sensors 116 are used to analyze and detect the formation fluid influx within the wellbore 102. The acceleration sensors 116 are also used to assist in validating the influx as the influx migrates in the annulus of the wellbore 102. By validating, the acceleration sensors determine that there is an influx and the influx is moving uphole through the wellbore 102. The acceleration sensors 116 can also be used to determine the expansion rate of the fluid influx by cross validating the damping factors. When two or more acceleration sensors 116 are used, each acceleration sensor 116 is used to determine an influx of the fluid 108 at different stages or depths of the annulus within the wellbore 102 and to determine an expansion rate of the influx of the fluid 108 at the different stages or depths of the annulus within the wellbore 102.

Figure 4B:
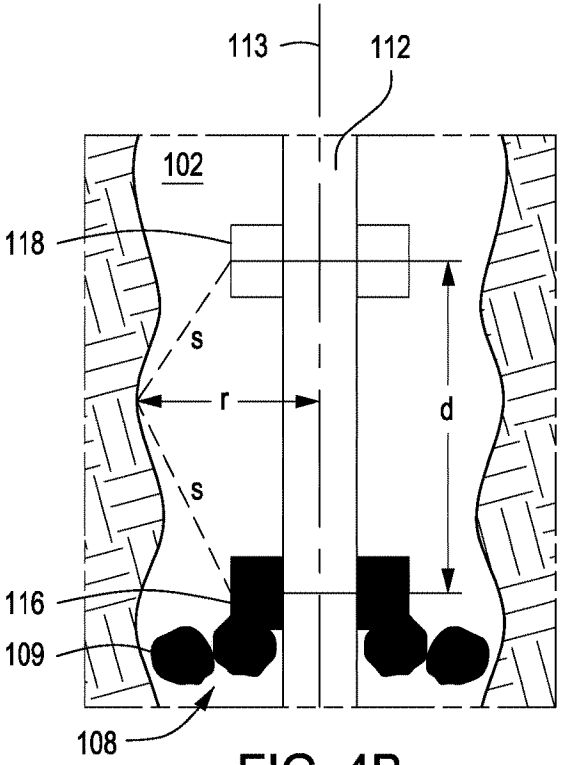
FIGS. 4A-4B depict a system including an acceleration sensor and an oscillator and used for detecting gas kick within a wellbore, according to one or more embodiments.
Figure 4A:
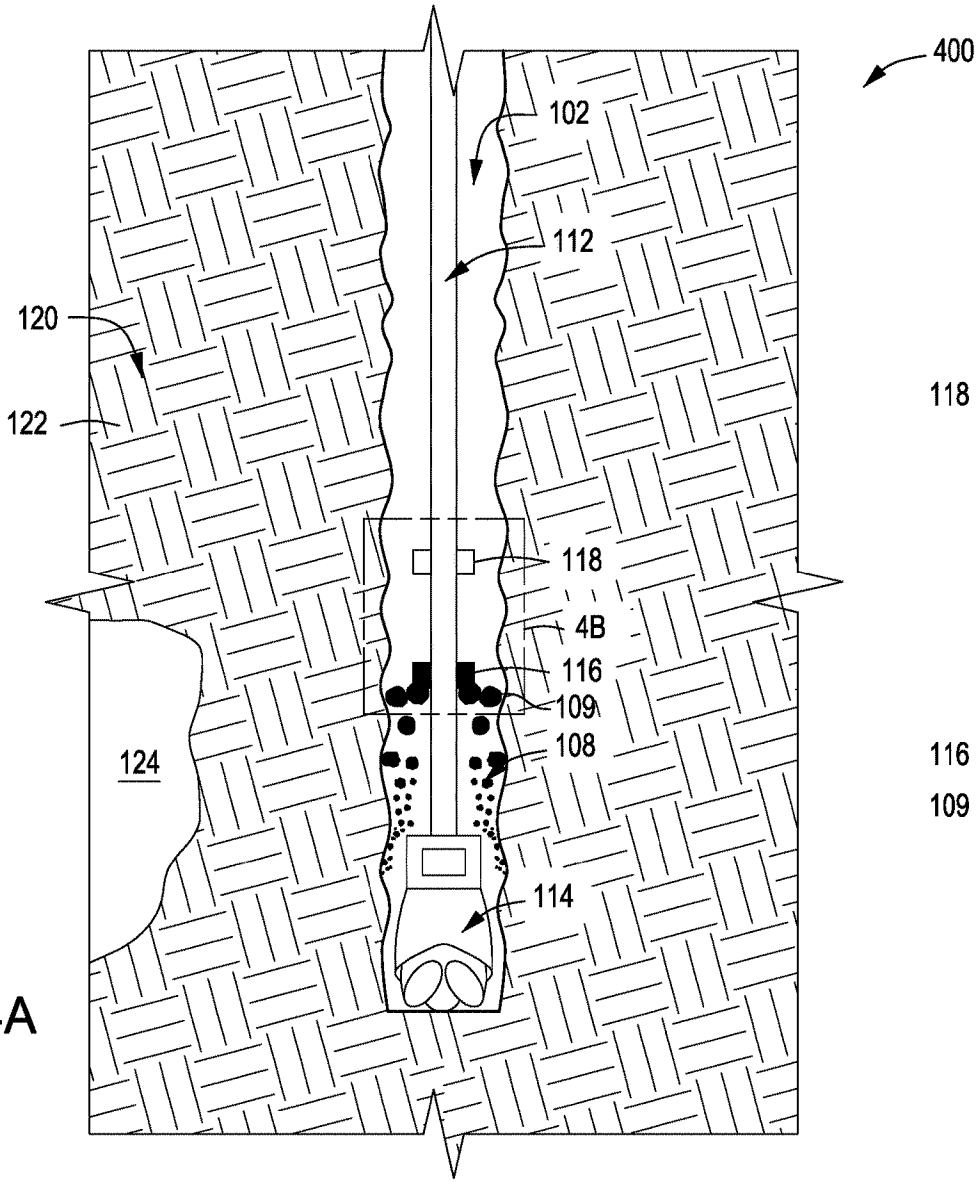

FIGS. 4A and 4B depict a drilling and detection system 400 including one or more acceleration sensors 116 and one or more oscillators 118 used to detect gas kicks within the wellbore 102, according to one or more embodiments. As depicted, the drill string 112 and the drill bit 114 are extended into the wellbore 102. The wellbore 102 is drilled into the subterranean region 120 that includes subsurface layers 122 and subterranean formations 124.

The oscillators 118 and the sensors 116 are coupled to the drill string 112 or other rotatable tool. The oscillators 118 are or include devices that generate waves by oscillation, agitation, vibration, and/or other movements. The oscillators 118 can be or include, but are not limited to, one or more of radial vibration oscillators (e.g., side-to-side or lateral vibration oscillators), axial vibration oscillators, torsional vibration oscillators, eccentrical vibration oscillators, vibrators, agitators, jars, other impact tools, or any combination thereof.

The oscillators 118 are positioned on the drill string 112 above the drill bit and are configured to generate one or more pressure waves at a predetermined frequency within the fluid 108 in the wellbore. The sensors 116 are similar to those described above and are positioned on the drill string 112 uphole from the drill bit 114, such as between the drill bit 114 and the oscillators 118. The oscillators 118 are positioned on the drill string 112 uphole from the drill bit 114. The sensors 116 are configured to measure the pressure of the fluid 108 in the wellbore to detect the pressure waves in the fluid 108 generated by the oscillators 118. In doing so, the sensors 116 monitor and measure the pressure waves at the predetermined frequency within the fluid 108 and produces a signal indicative of the measured movement of the fluid.

As an example, a pressure wave in the fluid 108 is generated by one or more oscillators 118. In some examples, a side-vibrating oscillator generates a pressure wave that travels forward to bottom of the wellbore 102 and gets reflected back similar to a sonic wave reflection. When the reflected stress wave returns back to the sensor 116, the sensor 116 detects the travel time and vibration speed.

The pressure wave from the oscillator can be expressed by the following equation:

$$a_a = a_0 \sin \omega t.$$

When the pressure wave gets reflected from the wellbore wall, the signal can be identified by an acceleration sensor or other tools that can detect pressure waves. Then the signal can be decomposed and the time between the off-time and return-time, T can be found. Then, the wave speed of the pressure wave between the oscillator and sensor is:

$$C = \sqrt{4r^2 + d^2}/T, \text{ wherein:}$$

C is the velocity of the pressure wave; r is the radius of the wellbore 102 or annulus; and d is the distance between the oscillator and the sensor, as depicted in FIG. 4B. A central axis 113 of the wellbore 102 and can be used as a reference for the radius r. The central axis 113 can also be common with the drill string 112. When there is formation fluid, the density of the fluid 108 is changed which further changes the velocity of the pressure wave. The acceleration sensor data can be compared against the baseline data as before to estimate the type of influx. The influx fluid density for at least one of oil, gas, water, or any combination thereof is determined and the mass influx of the fluid 108 is determined.

In other embodiments, a method for detecting the gas kick includes rotating the drill string 112 within the wellbore 102 in contact with the fluid 108, detecting a change in density of the fluid 108 within the wellbore 102 by at least one or more pressure waves, and determining presence of the gas kick within the wellbore 102 from the detected change in density of the fluid 108. The pressure wave can be generated by one or more vibrations, such as a radial vibration, a side vibration, a lateral vibration, an axial vibration, a torsional vibration, an eccentrical vibration, or any combination thereof.

The method includes producing a first pressure wave within the wellbore 102, measuring a first velocity of the first pressure wave within the wellbore 102, and determining a primary density of the fluid 108 from the first velocity of the first pressure wave. The method also includes producing a second pressure wave within the wellbore 102, measuring a second velocity of the second pressure wave within the wellbore 102, and determining a secondary density of the fluid 108 from the second velocity of the second pressure wave. If the primary and secondary densities are the same, then repeat measuring the velocity of additional pressure waves. If the primary and secondary densities are different, then determine presence of the gas kick within the wellbore 102 from the difference between the primary and secondary densities of the fluid 108.

Any of the systems 200, 300, and/or 400 can include 2, 3, 4, 5, 6, 7, 8, or 9 sensors 116 to about 10, about 12, about 15, about 20, about 30, about 50, about 100, about 150, about 200, about 250, or more sensors 116. For example, the rotatable tool or the drill string 112 of the systems 200, 300, and/or 400 can include 2 sensors to about 250 sensors, 2 sensors to about 100 sensors, 2 sensors to about 50 sensors, 10 sensors to about 250 sensors, 10 sensors to about 100 sensors, or 10 sensors to about 50 sensors.

Each of the sensors 116 are located on the drill string 112 and spaced apart or otherwise separated from the next closest sensor 116 by a distance of about 10, about 20, about 30, about 40, about 45, about 50, or about 60 feet to about 70, about 80, about 90, about 100, about 200, about 500, about 700, or about 1,000 feet. For example, the sensors 116 can be spaced apart or otherwise separated from the next closest sensor 116 by a distance of about 10 feet to about 1,000 feet, about 20 feet to about 500 feet, about 30 feet to about 100 feet, about 30 feet to about 90 feet, about 30 feet to about 60 feet, about 40 feet to about 100 feet, about 40 feet to about 90 feet, or about 40 feet to about 60 feet.

Figure 5:
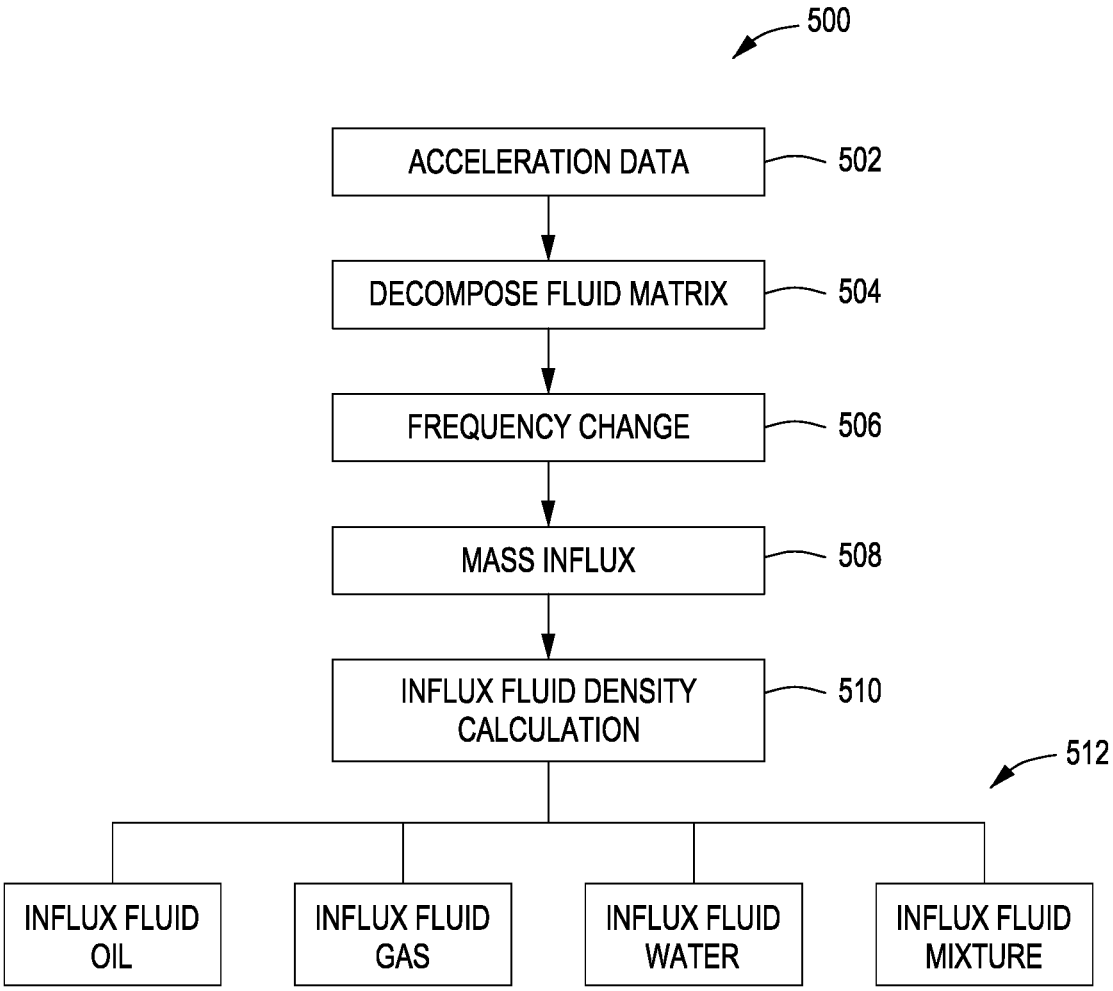
FIG. 5 depicts a flow chart illustrating methods that can be utilized when detecting a gas kick within a wellbore, according to one or more embodiments.

FIG. 5 depicts a flow chart illustrating method 500 that can be utilized when detecting a gas kick within a wellbore, according to one or more embodiments. The method 500 can be used with any of the systems 200, 300, and/or 400, as well as other drilling and detection systems not discussed or described herein. The method 500 includes acquiring acceleration data (502), decomposing the fluid matrix of the downhole fluid (504), determining the frequency change (506), determining the mass influx (508), and performing the influx fluid density calculation (510). The results of method 500 include the determination of the influx fluid oil, the influx fluid gas, the influx fluid water, and/or the influx fluid mixture thereof (512). Once the vibration and acceleration data from sensors is received at 502, the vibration data is analyzed through method 500 at 504-508. Then, the density and viscosity of the fluid is calculated at 510. The density and viscosity data of the fluid is used to determine the concentrations or influx of the oil, the gas, the water, and the mud (and/or other particulates) that are in the fluid.

The method 500 can be used to predict the well control volume change as the well is drilled. The alarm prediction unit monitors the drilling fluid mass and vibration data to predict drilling events. The alarm prediction unit may activate alarms for predefined drilling conditions, such as a kick alarm to provide an early warning of a dangerous fluid influx into the wellbore.

The method 500 for detecting a gas kick within a wellbore can be or include: one or more methods using one sensor point acceleration data that can be performed with the system 200; one or more methods using multisensory acceleration data that can be performed with the system 300; and one or more methods using acceleration sensor with other impact tools (e.g., oscillator or jar) that can be performed with the system 400; or any combination thereof.

In one or more embodiments, vibrations of the drill string are caused by movement of the drill bit during operation and/or one or more vibrators/oscillators. The vibration speed can be detected by the sensors. The gas bubbles rise up in the wellbore moving uphole toward the ground surface during a gas kick. The density and the viscosity of the drilling fluid with gas bubbles are less, so the sensors measured the drilling fluid with reduced density and viscosity as the fluid is passing the sensors. In the lower density and viscosity fluid, the drill sting generates a stronger vibration. As such, the sensor detects the stronger vibration signal when the gas bubbles are passing by the sensor. The locations of the bubbles and the speed and/or acceleration of the gas bubbles are detected by using the data from multiple sensors, such as two, three, or more sensors.

The high frequency downhole vibration data has a greater amount of information hidden than the low frequency surface data. Methods described and discussed herein include monitoring high frequency acceleration data for early kick detection. The trend of accelerator sensor values is monitored rather than processed values.

When the gas, fluid or oil kick happens, the fluid influx reduces the viscosity of the fluid in annulus of the wellbore which causes, the degradation of the damping factor. One or more sensors installed on the drill string detect the velocity and/or acceleration change resulting in the damping factor change. This approach includes analytical model to calculate the effect of damping ratio on the acceleration calculations. When the fluid influx into the wellbore happens and migrates, the damping factor will have a strong effect. The methods described and discussed herein include deconvoluting the sensor values using a combination of minimum entropy deconvolution and Teager-Kaiser energy operator to remove the noise, unwanted sensor values and likelihood of false prediction. The methods also include calculating instantaneous jerk and jerk intensity at each depth. The trend of the final intrinsic mode functions (IMF) at each depth or stage is continuously monitored to predict the formation influx if any. The IMF is used to analyze the vibration wave from the drill string or oscillator since the vibration data received from the sensors is mixed with background noise. The IMF analysis is conducted with a computer and is used to separate the vibration signal from background noise signal.

The methods described and discussed herein can be applied to cases in which fluid influx was observed and in which influx did not occur. Through continuous monitoring of IMF trend at each depth, it is observed that the IMF trend changes at the point of when the influx happens. In addition, monitoring of IMF energy with depth suggests that the IMF energy becomes negative when there is an influx. Thus, in at least one embodiment, the actual information is hidden in the data trend and not in the absolute sensor value or root mean square values and real time data monitoring can be made more reliable, simple and quick allowing the crew to take timely mitigation actions. In another aspect, the IMF energy can be calculated from the final IMF. The trend of this energy can be continuously monitored to make this process practical for real time data monitoring. The methods described and discussed herein are used for monitoring the incremental IMF and IMF energy at each depth. The methods are applied to extract information from high frequency vibration data to make real time data monitoring straightforward, reliable, and quick.

In addition to the embodiments described above, embodiments of the present disclosure further relate to one or more of the following paragraphs:

1. A method for detecting a gas kick within a wellbore through a subterranean formation containing a fluid, comprising rotating a tool within the wellbore and at least partially in contact with the fluid, detecting changes in rotational velocity of the tool within the wellbore, and detecting the gas kick within the wellbore.

2. A method for detecting a gas kick within a wellbore through a subterranean formation containing a fluid, comprising rotating a rotatable tool at least partially in contact with the fluid within the wellbore, detecting changes in rotational velocity of the rotatable tool within the wellbore to produce vibration data, determining a damping factor from the vibration data, determining a viscosity of the fluid, monitoring at least one of the damping factor or the viscosity, and determining presence of a gas bubble in the fluid by detecting a reduction of the damping factor or the viscosity.

3. A method for detecting a gas kick within a wellbore through a subterranean formation containing a fluid, comprising rotating a rotatable tool at least partially in contact with the fluid within the wellbore, detecting a change in density of the fluid within the wellbore by a pressure wave, and determining presence of the gas kick within the wellbore from the detected change in density of the fluid.

4. A system for detecting a gas kick within a wellbore through a subterranean formation containing a fluid, comprising an acceleration sensor coupled to a rotatable tool and configured to perform at least one, two, or more of: detect or determine changes in velocity of the rotatable tool, detect or determine changes in viscosity of the fluid, detect or determine changes in density of the fluid, detect or determine changes between shockwaves moving in the fluid, detect or determine changes in a mass influx of the fluid, or any combination thereof.

5. The system of paragraph 4, further comprising two or more acceleration sensors coupled to the rotatable tool, wherein each of the two or more acceleration sensors is configured to determine an influx of the fluid at different depths of the wellbore or an annulus, or an expansion rate of the influx of the fluid at different depths of the wellbore or the annulus.

6. The method or the system of any one of paragraphs 1-5, wherein the rotational velocity is detected by an acceleration sensor coupled to the rotatable tool.

7. The method or the system of any one of paragraphs 1-6, further comprising determining a mass influx of the fluid from the formation into the wellbore.

8. The method or the system of any one of paragraphs 1-7, further comprising determining an influx fluid density for at least one of oil, gas, water, or any combination thereof.

9. The method or the system of any one of paragraphs 1-8, wherein the rotational velocity is detected by two or more acceleration sensors coupled to the rotatable tool.

10. The method or the system of paragraph 9, wherein each of the two or more acceleration sensors determines an influx of the fluid at different depths of the wellbore or an annulus.

11. The method or the system of paragraph 9, wherein each of the two or more acceleration sensors determines an expansion rate of an influx of the fluid into the wellbore at different depths of the wellbore or an annulus.

12. The method or the system of any one of paragraphs 1-11, wherein detecting the change in density of the fluid within the wellbore by the pressure wave further comprises producing a first pressure wave within the wellbore, measuring a first velocity of the first pressure wave within the wellbore, determining a primary density of the fluid from the first velocity of the first pressure wave, producing a second pressure wave within the wellbore, measuring a second velocity of the second pressure wave within the wellbore, and determining a secondary density of the fluid from the second velocity of the second pressure wave, wherein the primary and secondary densities are different.

13. The method or the system of paragraph 12, wherein determining presence of the gas kick within the wellbore further comprises determining the difference between the primary and secondary densities of the fluid.

14. The method or the system of any one of paragraphs 1-13, wherein the pressure wave is generated by vibrations from rotating the rotatable tool.

15. The method or the system of any one of paragraphs 1-14, wherein the pressure wave is generated by at least one of a radial vibration, a side vibration, a lateral vibration, an axial vibration, a torsional vibration, an eccentrical vibration, or any combination thereof.

16. The method or the system of any one of paragraphs 1-15, wherein the density of the fluid is determined by an acceleration sensor coupled to the rotatable tool.

17. The method or the system of any one of paragraphs 1-16, wherein the pressure wave is generated by an oscillator.

18. The method or the system of paragraph 17, wherein the oscillator is coupled to the rotatable tool.

19. The method or the system of paragraph 17, wherein the oscillator is configured to generate pressure waves.

20. The method or the system of paragraph 17, wherein the oscillator comprises a vibrator, an agitator, a jar, an impact tool.

21. The method or the system of paragraph 17, wherein the oscillator comprises at least one of a radial vibration oscillator, a side vibration oscillator, a lateral vibration oscillator, an axial vibration oscillator, a torsional vibration oscillator, an eccentrical vibration oscillator, or any combination thereof.

22. The method or the system of any one of paragraphs 1-21, further comprising determining a mass influx of the fluid.

23. The method or the system of any one of paragraphs 1-22, further comprising determining an influx fluid density for at least one of oil, gas, water, or any combination thereof.

24. A system for performing the method of any one of paragraphs 1-3 and 6-23.

One or more specific embodiments of the present disclosure have been described. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

In the following discussion and in the claims, the articles "a," "an," and "the" are intended to mean that there are one or more of the elements. The terms "including," "comprising," and "having" and variations thereof are used in an open-ended fashion, and thus should be interpreted to mean "including, but not limited to . . . ." Also, any use of any form of the terms "connect," "engage," "couple," "attach," "mate," "mount," or any other term describing an interaction between elements is intended to mean either an indirect or a direct interaction between the elements described. In addition, as used herein, the terms "axial" and "axially" generally mean along or parallel to a central axis (e.g., central axis of a body or a port), while the terms "radial" and "radially" generally mean perpendicular to the central axis. The use of "top," "bottom," "above," "below," "upper," "lower," "up," "down," "vertical," "horizontal," and variations of these terms is made for convenience, but does not require any particular orientation of the components.

Certain terms are used throughout the description and claims to refer to particular features or components. As one skilled in the art will appreciate, different persons may refer to the same feature or component by different names. This document does not intend to distinguish between components or features that differ in name but not function.

Reference throughout this specification to "one embodiment," "an embodiment," "an embodiment," "embodiments," "some embodiments," "certain embodiments," or similar language means that a particular feature, structure, or characteristic described in connection with the embodiment may be included in at least one embodiment of the present disclosure. Thus, these phrases or similar language throughout this specification may, but do not necessarily, all refer to the same embodiment.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. A method for detecting a gas kick within a wellbore through a subterranean formation containing a fluid, comprising:

rotating a rotatable tool at least partially in contact with the fluid within the wellbore;

detecting changes in rotational velocity of the rotatable tool within the wellbore to produce vibration data;

determining a damping factor from the vibration data;

determining a viscosity of the fluid;

monitoring at least one of the damping factor or the viscosity; and determining presence of a gas bubble in the fluid by detecting a reduction of the damping factor or the viscosity.

2. The method of claim 1, wherein the rotational velocity is detected by an acceleration sensor coupled to the rotatable tool.

3. The method of claim 1, further comprising determining a mass influx of the fluid from the formation into the wellbore.

4. The method of claim 1, further comprising determining an influx fluid density for at least one of oil, gas, water, or any combination thereof.

5. The method of claim 1, wherein the rotational velocity is detected by two or more acceleration sensors coupled to the rotatable tool.

6. The method of claim 5, wherein each of the two or more acceleration sensors determines an influx of the fluid at different depths of the wellbore or an annulus.

7. The method of claim 5, wherein each of the two or more acceleration sensors determines an expansion rate of an influx of the fluid into the wellbore at different depths of the wellbore or an annulus.

8. A system for detecting a gas kick within a wellbore through a subterranean formation containing a fluid, comprising:

an acceleration sensor coupled to a rotatable tool and operable to detect or determine changes in velocity of the rotatable tool and detect or determine changes in viscosity of the fluid; and a computing and control system in electronic communication with the acceleration sensor and configured to:

determine a damping factor from vibration data produced based on the changes in velocity;

monitor at least one of the damping factor or the changes in viscosity; and determine presence of a gas bubble in the fluid by detecting a reduction of the damping factor or the viscosity.

9. The system of claim 8, further comprising two or more acceleration sensors coupled to the rotatable tool, wherein each of the two or more acceleration sensors is configured to determine:

an influx of the fluid at different depths of the wellbore or an annulus, or an expansion rate of the influx of the fluid at different depths of the wellbore or the annulus.

10. The system of claim 8, further comprising an oscillator coupled to the rotatable tool and configured to generate pressure waves.

11. The system of claim 10, wherein the oscillator comprises at least one of a radial vibration oscillator, a side vibration oscillator, a lateral vibration oscillator, an axial vibration oscillator, a torsional vibration oscillator, an eccentrical vibration oscillator, or any combination thereof.

12. The system of claim 8, wherein the acceleration sensor is further operable to detect or determine at least one of changes in density of the fluid, changes between shock-waves moving in the fluid, or changes in a mass influx of the fluid.

* * * * *